US006873238B2

(12) United States Patent
Kondo et al.

(10) Patent No.: US 6,873,238 B2
(45) Date of Patent: Mar. 29, 2005

(54) IGNITION COIL

(75) Inventors: Masahiro Kondo, Toyohashi (JP); Kazutoyo Osuka, Gamagori (JP); Shunichi Takeda, Nagoya (JP)

(73) Assignee: Denso Corporation (JP)

( * ) Notice: Subject to any disclaimer, the term of this patent is extended or adjusted under 35 U.S.C. 154(b) by 8 days.

(21) Appl. No.: 10/440,126

(22) Filed: May 19, 2003

(65) Prior Publication Data

US 2003/0222743 A1 Dec. 4, 2003

(30) Foreign Application Priority Data

May 31, 2002 (JP) ..... 2002-159747

(51) Int. Cl.[7] ..... H01F 5/00
(52) U.S. Cl. ..... 336/90; 336/96; 336/92
(58) Field of Search ..... 336/90, 92, 96; 123/634, 635

(56) References Cited

U.S. PATENT DOCUMENTS 5,778,863 A * 7/1998 Oosuka et al. ..... 123/634
6,426,032 B1 7/2002 Osuka et al.
6,474,322 B1 11/2002 Ubukata et al.
6,525,636 B1 * 2/2003 Oosuka et al. ..... 336/90

FOREIGN PATENT DOCUMENTS

| | | |
|---|---|---|
| EP | 1138939 A1 | 10/2001 |
| EP | 1253606 A1 | 10/2002 |
| JP | 7-153636 | 6/1995 |
| JP | A-11-37029 | 2/1999 |
| JP | A-11-40443 | 2/1999 |
| JP | 11-111547 | 4/1999 |
| JP | 2001-127239 | 5/2001 |

* cited by examiner

*Primary Examiner*—Anh Mai
(74) *Attorney, Agent, or Firm*—Nixon & Vanderhye PC

(57) ABSTRACT

An ignition coil has a connector electrically connected to an external circuit, an igniter for accommodating a switching element adapted to cause a current supplied from the connector to be intermittent, a primary coil portion for generating a predetermined voltage by the intermittent current, a secondary coil portion for stepping up the generated voltage and applying the resulting voltage to an ignition plug, and a resin insulating material which hardens in between the primary coil portion and the secondary coil portion to ensure insulation between the primary coil portion and the secondary coil portion. An outer shell of the igniter is formed of the resin insulating material.

12 Claims, 8 Drawing Sheets

IGNITION COIL

CROSS REFERENCE TO RELATED APPLICATION

This application is based upon, claims the benefit of priority of, and incorporates by reference, the contents of Japanese Patent Application No. 2002-159747 filed May 31, 2002.

BACKGROUND OF THE INVENTION

1. Technical Field of the Invention

The present invention relates to ignition coils, and more particularly, to an ignition coil which incorporates an igniter to apply a high voltage to an ignition plug.

2. Description of Related Art

For example, as an ignition coil of the type incorporating an igniter, an ignition coil which employs electrically insulating oil to ensure insulation is introduced in Japanese Patent Laid-Open Publication No. Hei 7-153636. A circuit module containing a power transistor, a primary coil portion, a secondary coil portion, and the like are accommodated inside the housing of the ignition coil in the publication. The housing also has a liquid electrical insulating oil injected therein. The electrical insulating oil ensures insulation between the aforementioned members.

On the other hand, an ignition coil which employs an epoxy resin to ensure insulation is introduced in Japanese Patent Laid-Open Publication No. Hei 2001-127239. An igniter, a primary coil portion, a secondary coil portion, and the like are accommodated inside the housing of the ignition coil described in the publication. The igniter is also formed of a heat sink, a hybrid integrated circuit, a power transistor, and the like, which are encapsulated in a molding resin.

FIG. 8 is an enlarged cross-sectional view showing the vicinity of the igniter in the ignition coil described in the publication. An igniter 100 comprises a heat sink 101, a power transistor 102, a hybrid integrated circuit 103, and an igniter terminal 104. The igniter 100 is placed on a mount 113. The power transistor 102 and the hybrid integrated circuit 103 are secured to the heat sink 101. An aluminum wire 106 electrically connects between the power transistor 102 and the hybrid integrated circuit 103. An aluminum wire 107 electrically connects the hybrid integrated circuit 103 and the igniter terminal 104. The hybrid integrated circuit 103 is covered with silicone rubber 105. These members are encapsulated in a molding resin 108 with the top end of the igniter terminal 104 protruded. The molding resin 108 forms an outer shell of the igniter 100. The igniter terminal 104 is jointed to a connector terminal 110, which lies in a connector 109. The connector terminal 110 is electrically connected to an engine control unit ECU. A housing 112 forming the outer shell of the ignition coil has an epoxy resin 111 injected therein to ensure insulation between the members accommodated inside the housing 112 and to secure each member. The housing 112 has the epoxy resin 111 filled and hardened in between the members therein.

However, the ignition coil described in Japanese Patent Laid-Open Publication No. Hei 7-153636, which ensures insulation by using the electrically insulating oil, raises the following problems. That is, the electrically insulating oil is a liquid. For this reason, a robust sealing mechanism is required to prevent the electrically insulating oil from leaking out of the ignition coil. This causes an increase in complexity of the structure of the ignition coil due to the sealing mechanism. This also causes an increase in the size of the ignition coil. This further causes an increase in manufacturing costs.

On the other hand, the ignition coil described in Japanese Patent Laid-Open Publication No. Hei 2001-127239, which ensures insulation by using the epoxy resin, raises the following problems. That is, double layers of a resin cover the heat sink 101, the power transistor 102, the hybrid integrated circuit 103, the silicone rubber 105, the aluminum wire 106, the aluminum wire 107, and part of the igniter terminal 104. That is, these members are doubly covered with the molding resin 108 and the epoxy resin 111. Accordingly, upon fabrication of the ignition coil, this requires the additional and independent steps of encapsulating the aforementioned members in the molding resin 108 to fabricate the igniter 100, and placing the fabricated igniter 100 on the mount 113 to inject and harden the epoxy resin 111. Accordingly, this increases the complexity of the fabrication process. This also causes an increase in manufacturing costs. This further causes an increase in complexity of the structure of the ignition coil due to the provision of the double resin layers. This further causes double electrical connections with the outside.

The ignition coil according to the present invention was completed in view of the aforementioned problems. It is therefore an object of the present invention to provide an ignition coil that can be fabricated at low costs in a simple structure and reduced in size.

SUMMARY OF THE INVENTION (1) To solve the aforementioned problems, the ignition coil of the present invention has a connector electrically connected to an external circuit, an igniter having a switching element for causing a current supplied from the connector to be intermittent, a primary coil portion for generating a predetermined voltage by the intermittent current; a secondary coil portion for stepping up the generated voltage and applying the resulting voltage to an ignition plug, and a resin insulating material which hardens in between the primary coil portion and the secondary coil portion to ensure insulation between the primary coil portion and the secondary coil portion. Also, with respect to the ignition coil, an outer shell of the igniter is formed by the resin insulating material.

That is, in the ignition coil of the present invention, the outer shell of the igniter is formed of the resin insulating material for ensuring insulation between the primary coil portion and the secondary coil portion. That is, for example, in FIG. 8 described above, the molding resin (108) is eliminated and the members accommodated in the igniter (100) are directly encapsulated in the epoxy resin (111).

According to the ignition coil of the present invention, the resin insulating material is in a solid state. This simplifies the sealing mechanism when compared with the electrically insulating oil used for insulation. Furthermore, according to the ignition coil of the present invention, the members to be accommodated in the igniter are covered with a single layer of the resin insulating material. For this reason, an additional step of encapsulating the members accommodated in the igniter in a molding resin is not necessary upon fabricating the ignition coil.

As described above, since the ignition coil of the present invention has a simple sealing mechanism and is covered with a single layer of the resin insulating material, the structure is simple. Additionally, the manufacturing process is simple, and the manufacturing cost is low.

Furthermore, since the ignition coil of the present invention has a simple sealing mechanism, it is easy to reduce its size. Accordingly, the ignition coil is preferably embodied as a stick-type ignition coil with a limited outer diameter (circumferential) due to its direct loading into a plughole.

(2) Preferably, the ignition coil has positioning means for positioning said igniter relative to said connector. The igniter is wired to the connector. According to this arrangement, the positioning means allows the igniter to be fixedly positioned relative to the connector. This facilitates the wiring operation. Furthermore, according to this arrangement, it is possible to prevent the igniter from rattling upon injecting the resin insulating material.

(3) Preferably, said igniter has a heat sink to which said switching element is secured, and said positioning means is a joint member for joining the heat sink and said connector together. The heat sink is relatively robust and has a large volume. For this reason, retaining and positioning the heat sink with the joint member allows the fixability of the igniter to be improved. It is therefore possible to prevent the igniter from rattling upon wiring and injecting the resin insulating material.

On the other hand, the joint member joints the igniter and the connector together. For this reason, this arrangement allows the igniter and the connector to be handled in one piece. Accordingly, upon fabrication of the ignition coil, the igniter and the connector can be first jointed together, the igniter and the connector can then be wired under this condition, and both the wired members can be loaded into the ignition coil. That is, after the wiring has been carried out in advance, the igniter can be loaded into the ignition coil. Accordingly, this arrangement facilitates the wiring operation.

(4) Preferably, said igniter further accommodates a control circuit for controlling said switching element. According to this arrangement, not only the switching element but also the control circuit are accommodated in the igniter and encapsulated in the resin insulating material. This eliminates additional wiring for connecting between the control circuit and the igniter when compared with the control circuit being solely placed. This improves the handleability of the ignition coil.

(5) Preferably, a coefficient of linear expansion of said resin insulating material is set at 750% or less, assuming that a coefficient of linear expansion of a material having the lowest coefficient of linear expansion, of materials forming said igniter, is 100%. The coefficient of linear expansion of the resin insulating material is set at 750% or less, assuming that the coefficient of linear expansion of a material having the lowest coefficient of linear expansion, of materials forming said igniter, is 100%. This is because thermal stress may cause a problem to the resin insulating material or the igniter at greater than 750%.

That is, suppose that the coefficient of linear expansion of the resin insulating material is significantly different from the coefficients of linear expansion of the materials forming the igniter. In this case, a significant thermal stress may be applied to the resin insulating material and the igniter due to thermal expansion or contraction caused by variations in ambient temperature. For example, thermal stress may cause problems such as cracking.

According to this arrangement, the difference in coefficient of linear expansion between the resin insulating material and the material forming each of the members constituting the igniter is small. Thus, it is possible to relieve the thermal stress applied to the resin insulating material and the igniter. This allows the ignition coil configured in this arrangement to be more reliable and longer-lasting.

(6) Preferably, the coefficient of linear expansion of said resin insulating material is set at 25 ppm/K or less. The reason why the coefficient of linear expansion of the resin insulating material is set at 25 ppm/K or less is because thermal stress may cause a problem to the resin insulating material or the igniter at greater than 25 ppm/K.

That is, for example, of each of the members constituting the igniter, Si used for semiconductors has a relative coefficient of linear expansion as low as 3.5 ppm/K. Thus, the coefficient of linear expansion of the resin insulating material being exceedingly higher than the coefficient of linear expansion of Si may cause a significant thermal stress to be applied to the resin insulating material and the igniter.

According to this arrangement, the difference in coefficient of linear expansion between the resin insulating material and the Si is small. Thus, it is possible to relieve the thermal stress applied to the resin insulating material and the igniter. This allows the ignition coil configured in this arrangement to be more reliable and have a longer life.

Therefore, according to the present invention, it is possible to provide an ignition coil that can be fabricated at low costs in a simple structure and reduced in size. Additionally, further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses. Now, an ignition coil of the present invention will be explained below in accordance with the embodiments.

(1) First Embodiment

Figure 1:
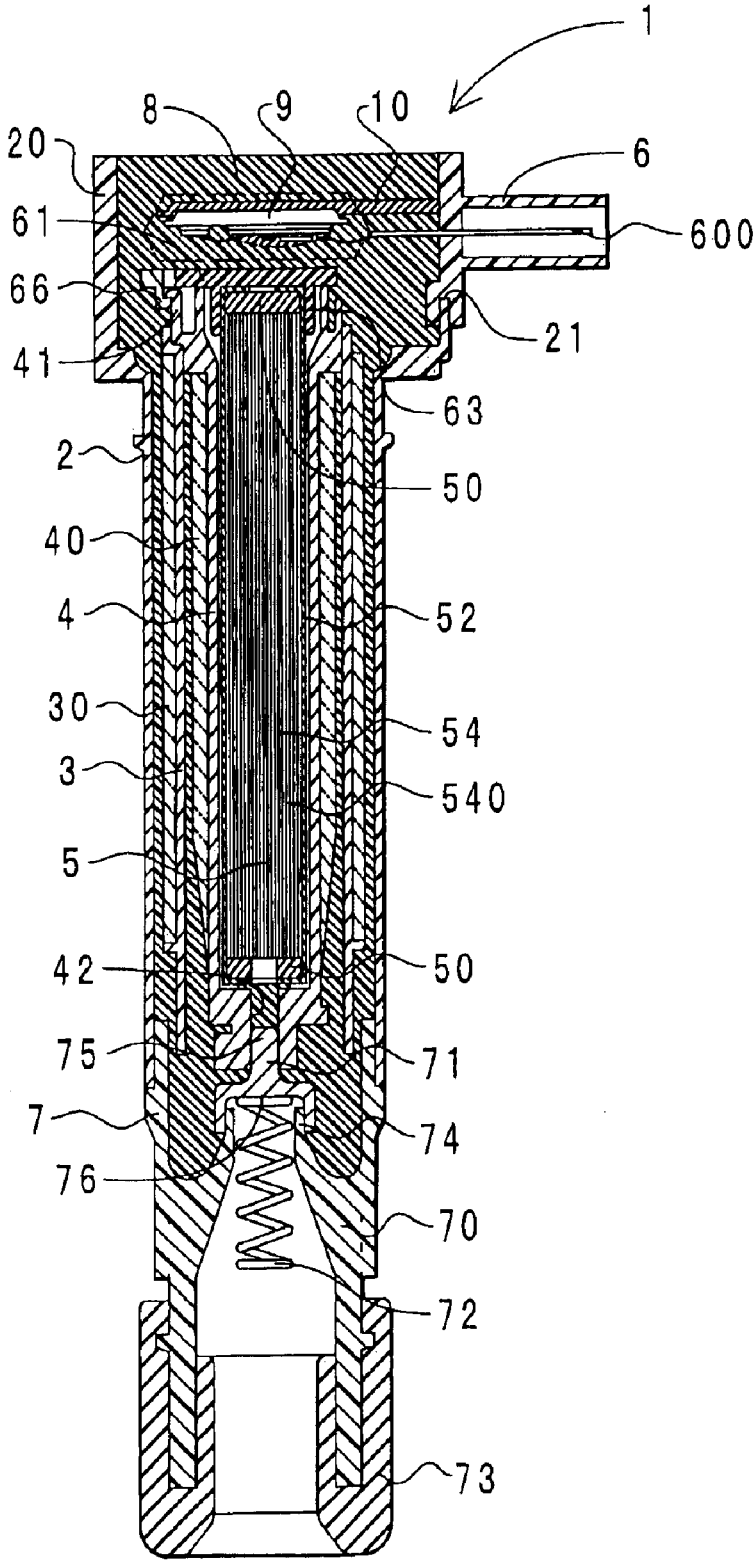
FIG. 1 is an axial, cross-sectional view showing an ignition coil according to a first embodiment.
Figure 2:
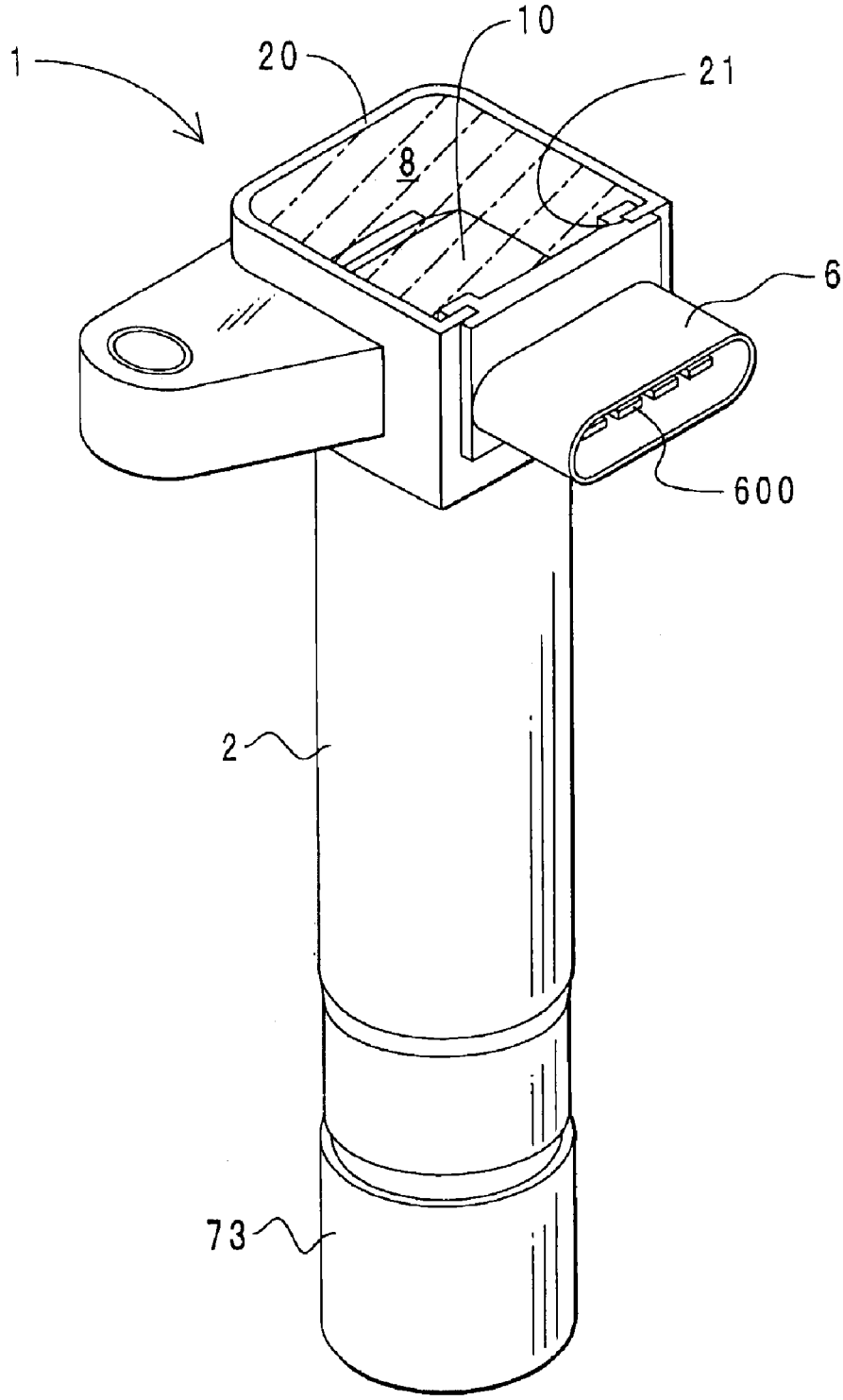
FIG. 2 is an external view showing the ignition coil according to the first embodiment.

The structure of the ignition coil according to this embodiment will first be described. FIG. 1 is an axial cross-sectional view showing the ignition coil according to this embodiment. FIG. 2 is an external view showing the ignition coil according to this embodiment. FIG. 2 is a view showing components through an epoxy resin. An ignition coil 1 of a stick type is accommodated in a plughole (not shown) formed in each cylinder on the upper portion of an engine block. As will be described later, the ignition coil 1 is connected to an ignition plug (not shown) at a lower side in the figure.

The ignition coil 1 comprises a housing 2. The housing 2 is made of a resin and takes the shape of a cylinder with a shoulder that is increased in diameter at an upper end. The portion below the shoulder is cylindrically shaped. On the other hand, the portion above the shoulder is rectangular shaped. Additionally, there is formed a wide opening 20 on the upper end portion of the housing 2. There is also formed a notched window 21 on part of a sidewall of the wide opening 20. A center core portion 5, a primary spool 3, a primary coil portion 30, a secondary spool 4, a secondary coil portion 40, a core alignment member 61, an igniter 9, and a joint member 10, which are each accommodated inside the housing 2.

In this arrangement, the center core portion 5 comprises a center core 54, an elastic member 50, and a heat-shrinkable tube 52. The center core 54 is formed of strip-shaped silicon steel plates 540, having different widths, stacked in the axial direction of the ignition coil 1, and takes the shape of a bar. The elastic member 50 is made of closed-cell sponge and takes a cylindrical shape. The elastic member 50 is placed on both the upper and lower ends of the center core 54. The heat-shrinkable tube 52 is made of a resin that shrinks by heating. The heat-shrinkable tube 52 covers the center core 54 and the elastic member 50 from the outer circumferential side.

The secondary spool 4 is made of a resin and is cylindrically shaped with a bottom. The secondary spool 4 is placed coaxially with the center core portion 5 and is adjacent to the outer circumference of the center core portion 5. The secondary coil portion 40 includes conductive wires wound around the outer circumferential surface of the secondary spool 4. There are vertically provided spool-side engagement pawls 41 on the upper end surface of the secondary spool 4. The spool-side engagement pawls 41, three in total, are spaced by 90 degrees in the circumferential direction.

The primary spool 3 is placed coaxially with the secondary spool 4 and adjacent to the outer circumference of the secondary spool 4. The primary coil portion 30 includes conductive wires wound around the outer circumferential side of the primary spool 3. Additionally, on the outer circumferential side of the primary coil portion 30, there is an outer circumferential cylindrical core (not shown) comprising one or more silicon steel plates and having a slit penetrating in the longitudinal direction.

A connector 6 is made of a resin and takes a prismatic shape. The connector 6 is disposed to protrude outwardly from the housing 2 through the notched window 21. The connector 6 has a plurality of connector terminals 600 insert molded therein. The core alignment member 61 takes a flat plate. The core alignment member 61 is placed generally at the center of the wide opening 20. From the lower surface of the core alignment member 61, there are, vertically provided, an alignment rib 63 and alignment-member-side engagement pawls 66. The alignment rib 63 has an annular shape. The alignment rib 63 is inserted from above in between the center core portion 5 and the secondary spool 4. The alignment-member-side engagement pawls 66, three in total, are spaced by 90 degrees in the circumferential direction. The alignment-member-side engagement pawls 66 are engaged with said spool-side engagement pawl 41.

The igniter 9 accommodates a power transistor, a hybrid integrated circuit, a heat sink, and the like. The power transistor is included in a switching device of the present invention. The hybrid integrated circuit is also included in a control circuit of the present invention. The igniter 9 is electrically connected to an ECU (not shown) and the primary coil portion 30. The ECU is included in an external circuit of the present invention. The igniter 9 will be described later. The joint member 10 joins (joints) the connector 6 and the heat sink together. The joint member 10 will also be described later.

An epoxy resin 8 is interposed between the aforementioned members placed inside the housing 2. An epoxy pre-polymer and a hardening agent are injected through the wide opening 20 and into the housing 2 that has been vacuumed (evacuated), thereby allowing the epoxy resin 8 to penetrate between the aforementioned members and harden. The epoxy resin 8 has a coefficient of linear expansion adjusted at 10 ppm/K. The epoxy resin 8 is included in a resin insulating material of the present invention.

A high-voltage tower portion 7 is disposed at a downward portion of the housing 2. The high-voltage tower portion 7 comprises a tower housing 70, a high-voltage terminal 71, a spring 72, and a plug cap 73. The tower housing 70 is made of a resin and takes a cylindrical shape. There is formed a boss portion 74 protruding upwardly generally at the mid-section on the inner circumferential side of the tower housing 70. The high-voltage terminal 71 is made of metal and takes the shape of a cup having a downwardly oriented opening 76. The downwardly oriented opening 76 has the boss portion 74 inserted therein. That is, the boss portion 74 supports the high-voltage terminal 71. There is placed a convex portion 75 protruding upwardly from the center of the upper end surface of the high-voltage terminal 71. The convex portion 75 is inserted into a lower end opening 42 of said secondary spool 4. The convex portion 75 is electrically connected to the secondary coil portion 40.

The spring 72 is spiral shaped. The upper end of the spring 72 is secured to the opening 76 of the high-voltage terminal 71. The spring 72 is in elastic contact with the ignition plug. The plug cap 73 is made of rubber and takes a cylindrical shape. The plug cap 73 is annularly installed at the lower end portion of the tower housing 70. The ignition plug is press fit into the inner circumferential side of the plug cap 73 and is in elastic contact therewith.

Now, a description will be made as to how the ignition coil 1 of this embodiment operates when energized. A control signal from the ECU is transmitted to the igniter 9 via the connector 6. A current caused by the igniter 9 to be intermittent allows a predetermined voltage to be generated in the primary coil portion 30 due to a self-induction effect. A mutual induction effect between the primary coil portion 30 and the secondary coil portion 40 causes this voltage to be stepped up. The resulting stepped-up high voltage is transmitted from the secondary coil portion 40 to the ignition plug via the high-voltage terminal 71 and the spring 72. This high voltage causes a spark to be generated in the gap of the ignition plug.

Figure 3:
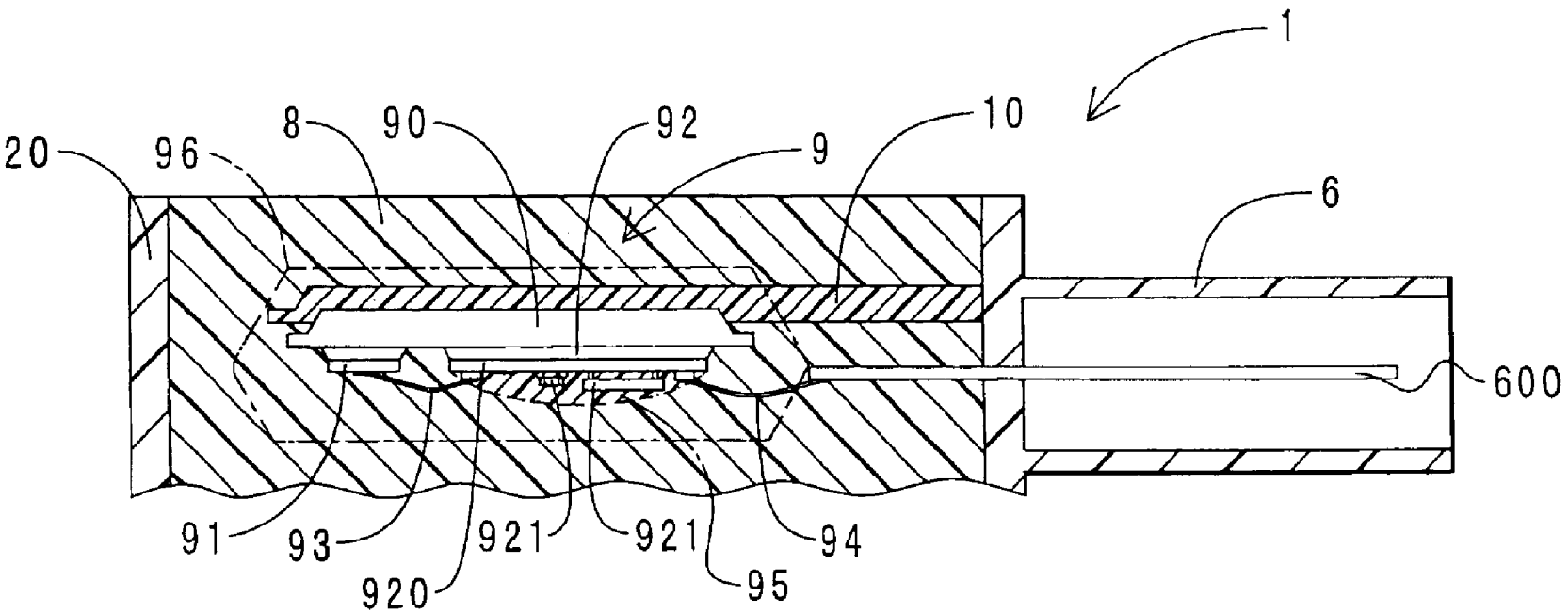
FIG. 3 is an enlarged cross-sectional view showing the vicinity of an igniter in the ignition coil according to the first embodiment.

Now, a detailed explanation is made on the configuration of the igniter 9. FIG. 3 is an enlarged cross-sectional view showing the vicinity of the igniter in the ignition coil of this embodiment. As shown, the igniter 9 comprises a heat sink 90, a power transistor 91, and a hybrid integrated circuit 92. The heat sink 90 is made of copper having a coefficient of linear expansion of 17 ppm/K and has a flat shape. The heat sink 90 is press fit into a concave portion of the joint member 10 secured to the connector 6. The power transistor 91 is soldered to the heat sink 90. The hybrid integrated circuit 92 comprises a circuit board 920 and an element 921. The element 921 is mainly formed of Si having a coefficient of linear expansion of 3.5 ppm/K.

The circuit board 920 is made of a ceramic and is of a flat shape. The circuit board 920 is adhered to the heat sink 90. The circuit board 920 has a plurality of elements 921 soldered thereto. An aluminum wire 93 connects between the power transistor 91 and the hybrid integrated circuit 92. An aluminum wire 94 connects between the hybrid integrated circuit 92 and the connector terminal 600. The hybrid integrated circuit 92 is covered with silicone rubber 95. The silicone rubber 95 serves to relieve thermal stress between the epoxy resin 8 and the hybrid integrated circuit 92. These members are encapsulated in the epoxy resin 8 in conjunction with said primary coil portion 30, the secondary coil portion 40, and the like. In other words, as indicated by an alternate long and short dashed line, an outer shell 96 of the igniter 9 is formed of the epoxy resin 8.

Figure 4:
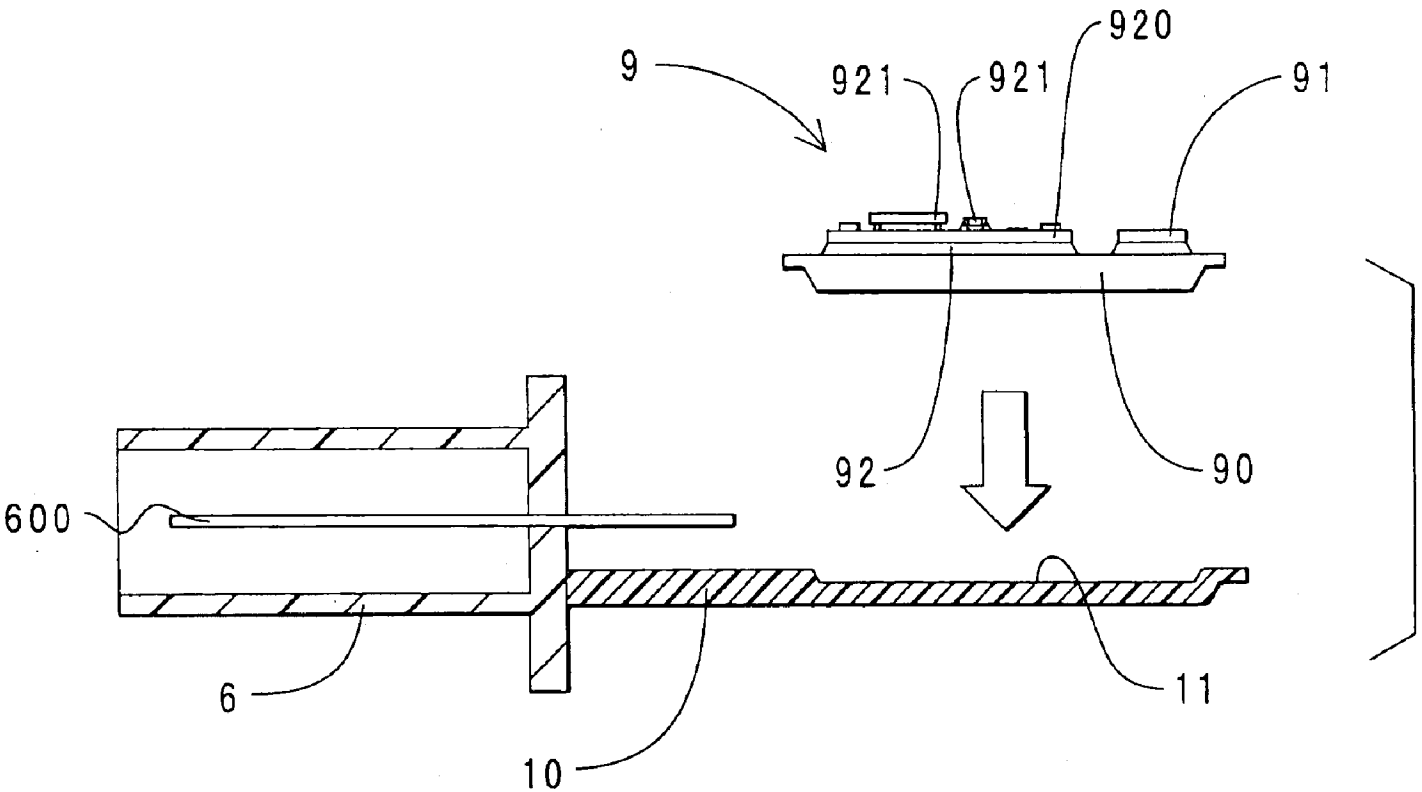
FIG. 4 is a view showing a state where the igniter in the ignition coil according to the first embodiment is assembled to a joint member.

Now, a description will be made as to how the ignition coil of this embodiment is assembled. FIG. 4 is a view showing a state where the igniter is assembled into the joint member. As shown, the connector 6 is disposed upside down with respect to the one shown in FIG. 3. There is formed a concave portion 11 on the upper surface of the joint member 10, which is disposed upside down.

For the assembly, the connector 6 is first prepared. The joint member 10 is then secured to the connector 6. The connector 6 and the joint member 10 may be formed in one piece. The power transistor 91 and the hybrid integrated circuit 92 are also secured to the heat sink 90. Subsequently, as shown by a hollow arrow in the figure, the heat sink 90 is press fit into the concave portion 11.

Figure 5:
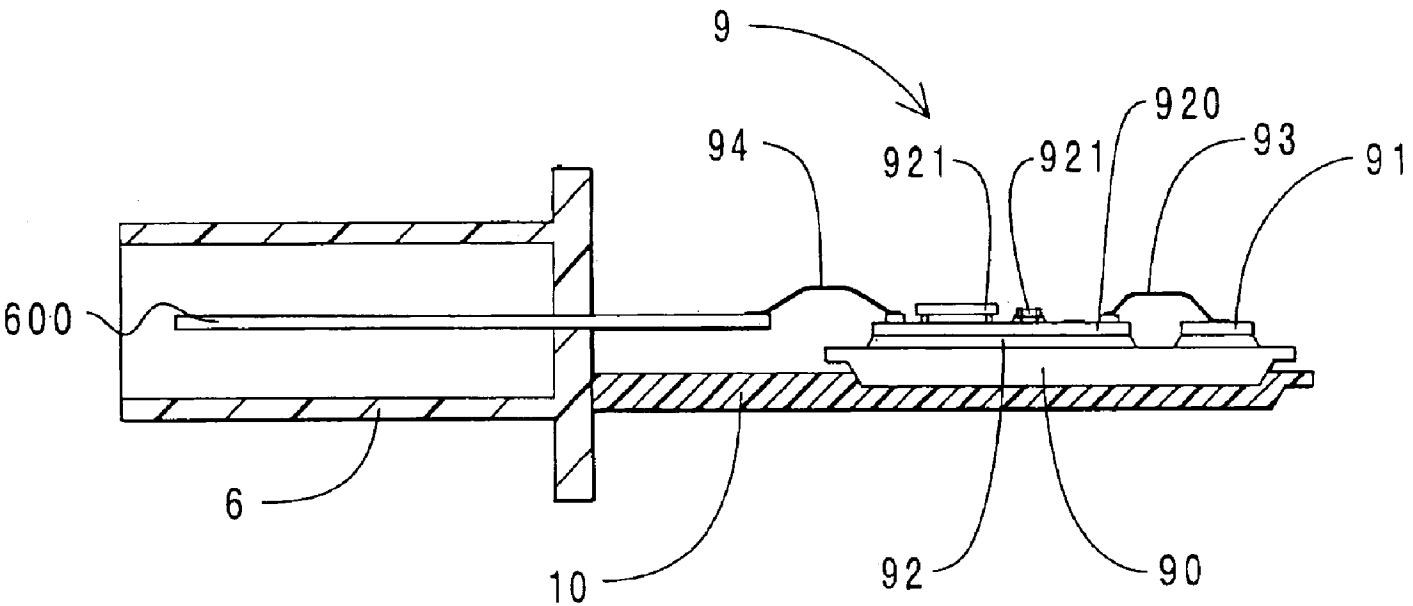
FIG. 5 is a view showing a state where the igniter in the ignition coil according to the first embodiment is wired to a connector.

FIG. 5 shows a state where the igniter is wired to the connector. The aluminum wire 94 then connects between the hybrid integrated circuit 92 and the connector terminal 600. More specifically, the aluminum wire 94 is ultrasonically bonded onto the hybrid integrated circuit 92 and the connector terminal 600. The aluminum wire 93 also connects between the hybrid integrated circuit 92 and the power transistor 91. More specifically, the aluminum wire 93 is ultrasonically bonded onto the hybrid integrated circuit 92 and the power transistor 91. In this manner, conduction between the connector terminal 600 and the hybrid integrated circuit 92 and the power transistor 91 is ensured. Thereafter, the upper surface of the hybrid integrated circuit 92 is sealed with silicone rubber (not shown).

An assembly of the igniter 9 and the connector 6 is assembled into a housing in which the primary coil portion and the secondary coil portion and the like have been accommodated in advance. More specifically, as previously shown in FIG. 2, the connector 6 is fitted into the notched window 21, thereby assembling the assembly of the igniter 9 and the connector 6 into the housing 2. While the housing 2 is being vacuumed (evacuated), the epoxy resin 8 is injected through the wide opening 20. Finally, the injected epoxy resin 8 is allowed to penetrate in between each of the members and become hardened by heating. In this manner, the ignition coil of this embodiment is assembled.

Now, the effects of the ignition coil of this embodiment will be described. According to the ignition coil 1 of this embodiment, a solid-state epoxy resin 8 is used as a resin insulating material. This simplifies the sealing mechanism.

Furthermore, according to the ignition coil 1 of this embodiment, the members accommodated in the igniter 9 such as the heat sink 90, the power transistor 91, and the hybrid integrated circuit 92 are covered with a single layer of the epoxy resin 8. For this reason, an additional step of encapsulating the aforementioned members in a molding resin is not necessary upon fabricating the ignition coil.

The ignition coil 1 of this embodiment comprises the joint member 10 as positioning means. This allows the igniter 9 and the connector 6 to be handled in one piece. Accordingly, after the igniter 9 and the connector 6 have been wired, the assembly of both of these members can be placed in the housing 2. That is, this provides handling advantages upon fabrication. Furthermore, the heat sink 90 is press fit into the concave portion 11. This allows the igniter 9 to remain secure and not rattle with respect to the connector 6. Accordingly, the wiring operation is easy to carry out. The epoxy resin 8 is also easy to inject.

The ignition coil 1 of this embodiment accommodates the power transistor 91 as well as the hybrid integrated circuit 92 in the igniter 9. This provides a handling advantage to the ignition coil 1 over an ignition coil 1 having an external hybrid integrated circuit 92.

Figure 8:
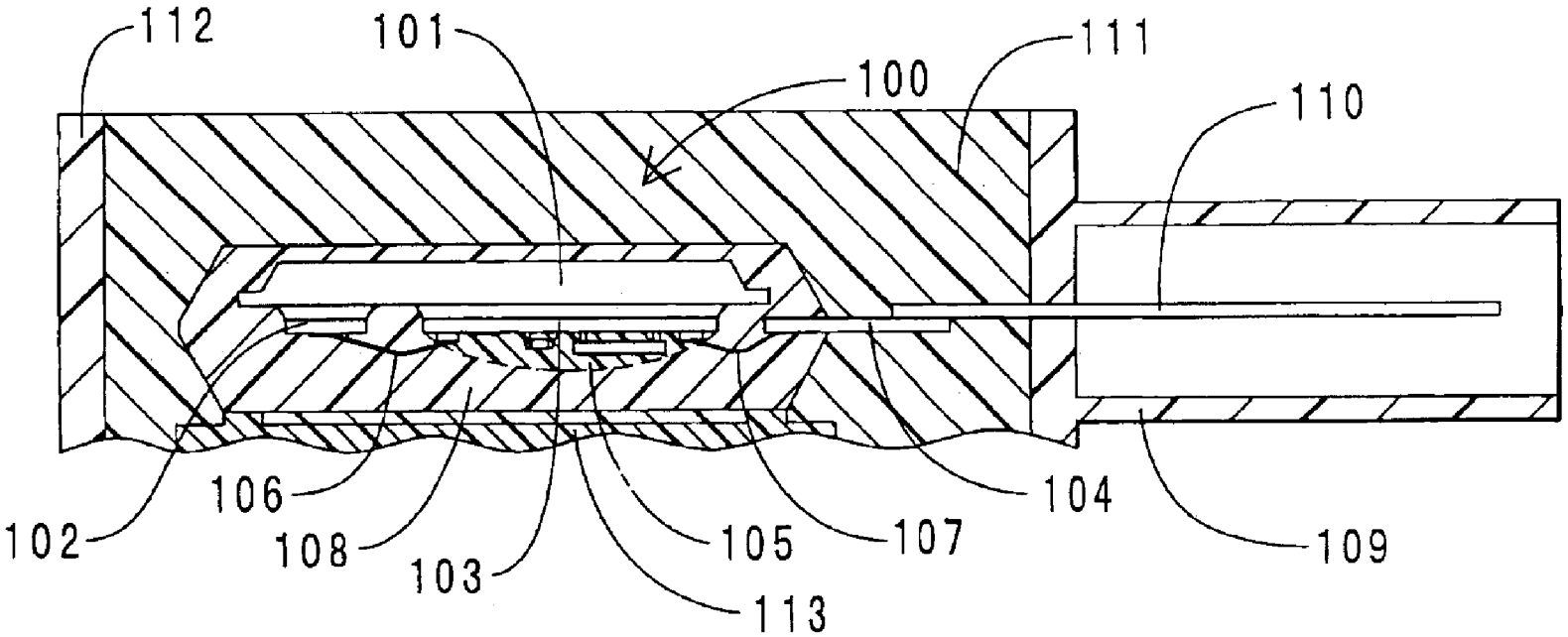
FIG. 8 PRIOR ART
FIG. 8 is an enlarged cross-sectional view showing the vicinity of an igniter in a prior art ignition coil.

The epoxy resin 8 of the ignition coil 1 according to this embodiment has a coefficient of linear expansion of 10 ppm/K. On the other hand, the copper forming the heat sink 90 has a coefficient of linear expansion of 17 ppm/K. The Si included in the elements 921 has a coefficient of linear expansion of 3.5 ppm/K. That is, the coefficient of linear expansion of the epoxy resin 8 is set at a substantially median value of the coefficients of linear expansion of the copper and Si. According to the ignition coil 1 of this embodiment, it is possible to relieve a thermal stress applied to the epoxy resin 8 and the igniter 9. Thus, the ignition coil 1 of this embodiment is increased in reliability and life. On the other hand, the ignition coil 1 of this embodiment is not provided with the igniter terminal 104 as previously shown in FIG. 8. This reduces the number of parts required.

(2) Second Embodiment

This embodiment differs from the first embodiment in that the positioning means is secured to the housing, and as well the connector and the igniter are not handled in one piece. Accordingly, the description here will be made only with respect to the differences.

Figure 6:
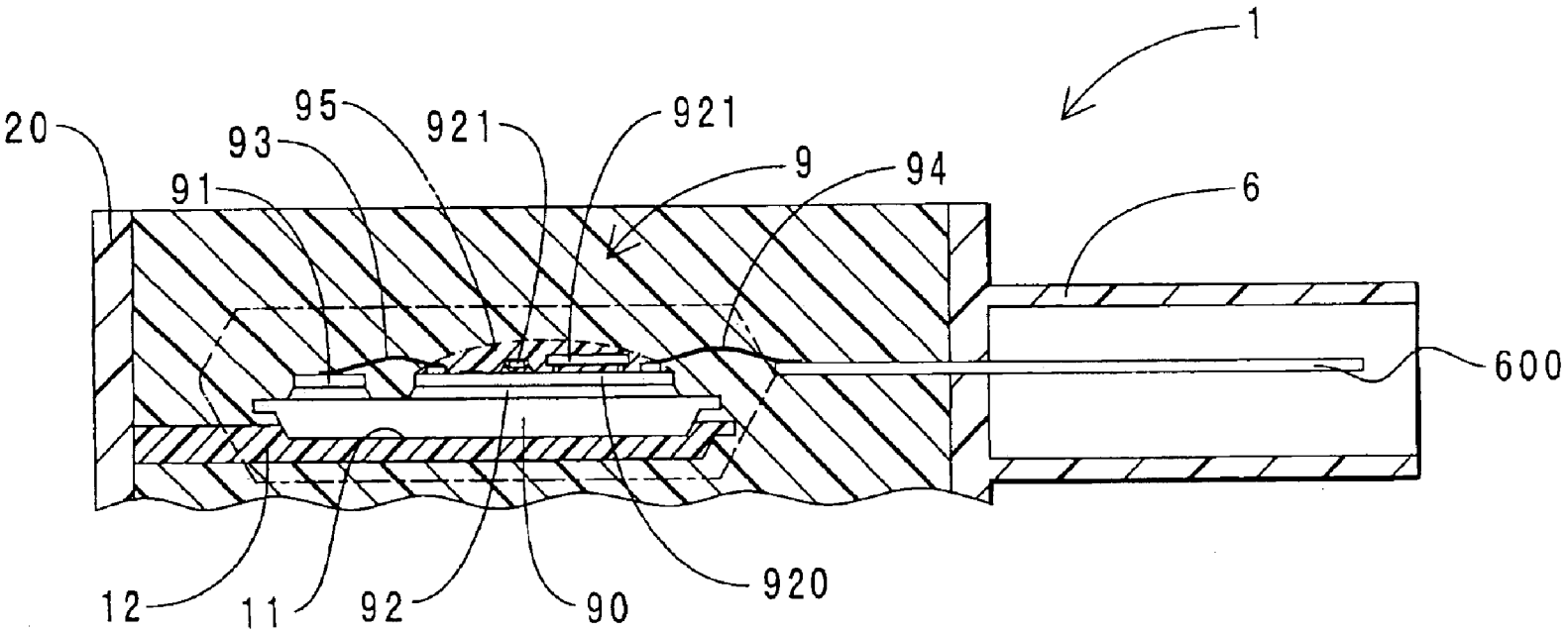
FIG. 6 is an enlarged cross-sectional view showing the vicinity of an igniter in an ignition coil according to a second embodiment.

FIG. 6 is an enlarged cross-sectional view showing the vicinity of the igniter in the ignition coil according to this embodiment. The components corresponding to those of FIG. 3 are indicated with the same symbols. As shown, positioning means 12 is secured to the wide opening 20 of the housing. The upwardly-oriented concave portion 11 is formed on the upper surface of the positioning means 12. The heat sink 90 of the igniter 9 is press fit from above into the concave portion 11. That is, the igniter 9 and the positioning means 12 of this embodiment are placed upside down with respect to those of the first embodiment.

The ignition coil 1 of this embodiment is assembled in the following steps. First, the members such as the primary coil portion and the secondary coil portion are accommodated inside the housing. Then, the connector 6 is fitted into the notched window of the wide opening 20. The igniter 9 is also press fit into the concave portion 11. Thereafter, the aluminum wire 94 connects between the connector terminal 600 and the hybrid integrated circuit 92. The aluminum wire 93 also connects between the hybrid integrated circuit 92 and the power transistor 91. The hybrid integrated circuit 92 is then covered with the silicone rubber 95. Finally, the epoxy resin 8 is injected through the wide opening 20 into the housing that has been vacuumed (evacuated) and then allowed to harden.

According to the ignition coil 1 of this embodiment, the igniter 9 is press fit into the concave portion 11 on the upper surface of the positioning means 12. This prevents the igniter 9 from falling off from the positioning means 12 upon injecting the epoxy resin 8. As the ignition coil 1 of this embodiment, even when the positioning means 12 is secured to the wide opening 20 of the housing, it is possible to position the igniter 9 relative to the connector 6. This facilitates the wiring and the injection operations of the epoxy resin 8.

(3) Third Embodiment

This embodiment differs from the first embodiment in that the present invention is embodied in an ignition coil other than one of the stick type. Accordingly, the description here will be made only on the differences.

Figure 7:
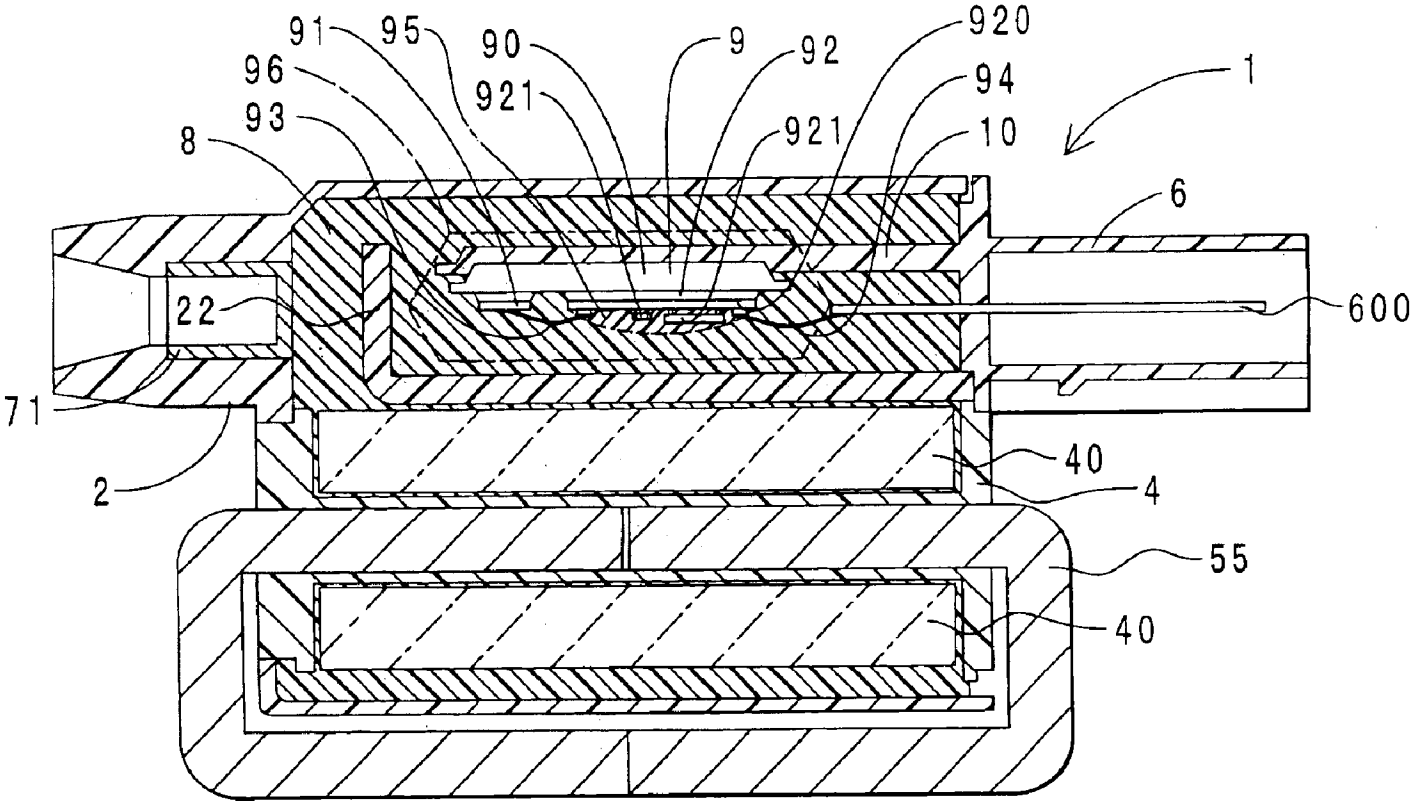
FIG. 7 is an axial, cross-sectional view showing an ignition coil according to a third embodiment.

FIG. 7 is an axial cross-sectional view showing the ignition coil of this embodiment. In FIGS. 1 and 3, the same components are indicated with the same symbols. The ignition coil 1 comprises the housing 2 made of a resin. There are cores 55, a primary spool (not shown), a primary coil portion (not shown), the secondary spool 4, the secondary coil portion 40, the joint member 10, the high-voltage terminal 71, and a partition plate 22, each of which are accommodated inside the housing 2.

The core 55 takes the shape of an oval in cross section with the "C"-shaped cores being assembled together. The primary spool is made of a resin and is prismatic in shape. The primary spool is placed on the outer circumference side of the core 55. The primary coil portion includes conductive wires wound around the outer circumference surface of the primary spool. The secondary spool 4 is made of a resin and is prismatic shaped. The secondary spool 4 is placed on the outer circumference side of the primary coil portion. The secondary coil portion 40 includes conductive wires wound around the outer circumference surface of the secondary spool 4.

The connector 6 is made of a resin and takes a prismatic shape. The connector 6 is disposed to protrude outwardly from the housing 2. The connector 6 has a plurality of connector terminals 600 insert molded therein. The joint member 10 is formed integrally with the connector 6. The igniter 9 accommodates the power transistor 91, the hybrid integrated circuit 92, the heat sink 90, and the like. The heat sink 90 is fixedly press fit into the concave portion of the joint member 10.

The epoxy resin 8 is interposed between the aforementioned members placed inside the housing 2. An epoxy pre-polymer and a hardening agent are injected into the housing 2, thereby allowing the epoxy resin 8 to penetrate between the aforementioned members and harden. The high-voltage terminal 71 is electrically connected to the secondary coil portion 40.

The ignition coil of this embodiment is assembled in the following steps. First, the connector 6 and the joint member 10 are fabricated in one piece. The power transistor 91 and the hybrid integrated circuit 92 are also secured to the heat sink 90. Then, the heat sink 90 of the igniter 9 is press fit into the concave portion of the joint member 10 (see FIG. 4). Subsequently, the power transistor 91 and the hybrid integrated circuit 92 are wired. The hybrid integrated circuit 92 and the connector terminal 600 are also wired (see FIG. 5). Thereafter, an assembly of the igniter 9 and the connector 6 is assembled into a space above the partition plate 22 of the housing 2 in which the primary coil portion and the secondary coil portion 40 are accommodated, and the C-shaped cores are fitted from both sides thereby allowing the cores 55 to be assembled. The epoxy resin 8 is then injected into the housing 2. Finally, the epoxy resin 8 is allowed to penetrate between the members and harden by heating.

The ignition coil 1 of this embodiment can provide the same effects as those of the ignition coil of the first embodiment. That is, the ignition coil 1 requires no sealing mechanism for electrically insulating oil. Furthermore, an additional step of encapsulating the members to be accommodated in the igniter 9 in a molding resin is not necessary upon fabricating the ignition coil.

Furthermore, since the joint member 10 is provided as positioning means, the igniter 9 and the connector 6 can be handled in one piece. Accordingly, this provides handling advantages upon fabrication. Furthermore, the heat sink 90 is press fit into the concave portion. This makes wiring operations easy to carry out. This also facilitates the injection operation of the epoxy resin 8. Furthermore, the hybrid integrated circuit 92 is accommodated in the igniter 9. This provides handling advantages to the ignition coil 1.

The epoxy resin 8 of the ignition coil 1 according to this embodiment has a coefficient of linear expansion of 10 ppm/K. On the other hand, the copper forming the heat sink 90 has a coefficient of linear expansion of 17 ppm/K. The Si included in the elements 921 has a coefficient of linear expansion of 3.5 ppm/K. That is, the coefficient of linear expansion of the epoxy resin 8 is set at a substantially median value of the coefficients of linear expansion of the copper and Si. It is thus possible to relieve a thermal stress applied to the epoxy resin 8 and the igniter 9.

Furthermore, the joint member 10 in the ignition coil 1 according to this embodiment is formed integrally with the connector 6. For this reason, this embodiment eliminates the need for an additional step of securing the joint member 10 to the connector 6 upon assembly of the ignition coil. This simplifies the fabrication process.

(4) Others

The embodiments of the ignition coil according to the present invention have been described in the foregoing. However, the embodiments are not limited to any of the aforementioned forms. It is also possible to implement various modifications and improvements that can be made by those skilled in the art. For example, the method for adjusting the coefficient of linear expansion of the epoxy resin 8 is not limited to any particular one. For example, filler may be dispersed in the epoxy resin 8 to thereby adjust the coefficient of linear expansion thereof. It is not necessary to set the coefficient of linear expansion of the epoxy resin 8 at a generally median value of the coefficients of linear expansion of the copper forming the heat sink 90 and the Si included in the elements 921. For example, it is also acceptable to employ a value close to the coefficient of linear expansion of the Si that has a lower coefficient of linear expansion. On the other hand, it is also acceptable to employ a value close to the coefficient of linear expansion of the copper in view of the heat sink 90 having a relatively large volume. Furthermore, the connector 6 doesn't need to have the connector terminal 600. For example, the connector 6 may be a simple wire. That is to say, it is only required to be able to electrically connect between the igniter 9 and an external circuit. Furthermore, the igniter 9 does not need to have the heat sink 90 and the control circuit 92. For example, it may be formed only of the switching element 91. It also does not need to have the silicone rubber 95.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An ignition coil comprising:

a connector for electrical connection;

an igniter having a switching element for causing a current supplied through the connector to be intermittent; a primary coil portion for generating a predetermined voltage by the intermittent current;

a secondary coil portion that steps up the generated voltage and applies the resulting voltage to an ignition plug; and a resin insulating material which hardens between the primary coil portion and the secondary coil portion to ensure insulation between the primary coil portion and the secondary coil portion, wherein an outer shell of the igniter is formed of the resin insulating material.

2. The ignition coil according to claim 1, further comprising: positioning means for positioning said igniter relative to said connector.

3. The ignition coil according to claim 2, said igniter further comprising:

a heat sink to which said switching element is secured, and wherein said positioning means is a joining member for joining the heat sink and said connector together.

4. The ignition coil according to claim 1, wherein said igniter further accommodates a control circuit for controlling said switching element.

5. The ignition coil according to claim 1, wherein said resin insulating material has a coefficient of linear expansion equal to or less than 750% of said igniter coefficient of linear expansion when a coefficient of linear expansion of a material having a lowest coefficient in materials forming said igniter is 100%.

6. The ignition coil according to claim 1, wherein the coefficient of linear expansion of said resin insulating material is set at 25 ppm/K or less.

7. The ignition coil according to claim 1, wherein said outer shell is simultaneously formed with said resin insulating material which hardens between the primary coil portion and the secondary coil portion.

8. The ignition coil according to claim 1, wherein said primary coil portion comprises a primary spool and a primary coil wound around the outer circumferential side of the primary spool, said secondary coil portion comprises a secondary spool and a secondary coil wound around the outer circumferential side of the secondary spool, and said resin insulating material hardens between the primary spool and the secondary coil.

9. The ignition coil according to claim 8, wherein said secondary spool is disposed radially within said primary spool.

10. The ignition coil according to claim 8, wherein the primary spool is coaxial with the secondary spool.

11. An ignition coil comprising:

a connector for electrical connection;

an igniter having a switching element for causing a current supplied through the connector to be intermittent;

a primary coil portion for generating a predetermined voltage by the intermittent current;

a secondary coil portion that steps up the generated voltage and applies the resulting voltage to an ignition plug; and a resin insulating material which hardens between the primary coil portion and the secondary coil portion to ensure insulation between the primary coil portion and the secondary coil portion, wherein an outer shell of the igniter is formed of the resin insulating material; and positioning means for positioning said igniter relative to said connector, wherein said resin insulating material has a coefficient of linear expansion equal to or less than 750% of said igniter coefficient of linear expansion when a coefficient of linear expansion of a material having a lowest coefficient in materials forming said igniter is 100%.

12. An ignition coil comprising:

a connector for electrical connection;

an igniter having a switching element for causing a current supplied through the connector to be intermittent;

a primary coil portion for generating a predetermined voltage by the intermittent current;

a secondary coil portion that steps up the generated voltage and applies the resulting voltage to an ignition plug; and a resin insulating material which hardens between the primary coil portion and the secondary coil portion to ensure insulation between the primary coil portion and the secondary coil portion, wherein an outer shell of the igniter is formed of the resin insulating material, said igniter further accommodates a control circuit for controlling said switching element, and said resin insulating material has a coefficient of linear expansion equal to or less than 750% of said igniter coefficient of linear expansion when a coefficient of linear expansion of a material having a lowest coefficient in materials forming said igniter is 100%.

* * * * *